US009770394B1

(12) United States Patent
Velazquez

(10) Patent No.: US 9,770,394 B1
(45) Date of Patent: Sep. 26, 2017

(54) BABY FEEDING PACIFIER WITH ENCLOSED EDIBLE PRODUCT

(71) Applicant: Erik Velazquez, Palmetto Bay, FL (US)

(72) Inventor: Erik Velazquez, Palmetto Bay, FL (US)

( * ) Notice: Subject to any disclaimer, the term of this patent is extended or adjusted under 35 U.S.C. 154(b) by 266 days.

(21) Appl. No.: 14/790,828

(22) Filed: Jul. 2, 2015

(51) Int. Cl.
*A61J 17/00* (2006.01)

(52) U.S. Cl.
CPC ..... *A61J 17/00* (2013.01)

(58) Field of Classification Search
CPC ..... A61J 17/00; A61J 17/001; A61J 17/002; A61J 17/003; A61J 17/005; A61J 17/006; A61J 17/007; A61J 17/008
See application file for complete search history.

(56) References Cited

U.S. PATENT DOCUMENTS 4,193,407 A * 3/1980 Edmark ..... A61J 17/001 606/234
4,324,249 A * 4/1982 Sundkvist ..... A61J 17/001 606/236
4,402,321 A * 9/1983 Berg ..... A61J 17/001 606/236
4,586,621 A * 5/1986 Dahan ..... A61J 11/0005 215/11.1
4,716,902 A * 1/1988 Swartz ..... A61J 17/005 362/800
4,768,510 A * 9/1988 Leung ..... A61J 17/001 606/234
4,796,628 A * 1/1989 Anderson ..... A61J 15/0011 606/236
5,127,903 A * 7/1992 Mailot ..... A61J 7/0046 604/77
5,178,466 A * 1/1993 Chiu ..... G01K 3/005 215/11.2
5,342,398 A * 8/1994 Sun ..... A61J 17/001 606/234
5,522,847 A * 6/1996 Kalis ..... A61J 17/005 606/234
5,578,004 A * 11/1996 Liang ..... A61J 7/0053 604/77
5,578,058 A * 11/1996 Chen ..... A61J 17/001 606/234
6,139,566 A * 10/2000 Bennett ..... A61J 7/0046 606/234
2001/0047189 A1* 11/2001 Griffith ..... A61J 17/001 606/234

(Continued)

*Primary Examiner* — Jonathan Miles
(74) *Attorney, Agent, or Firm* — Glenn E. Gold, P.A.; Glenn E. Gold; David Colls

(57) ABSTRACT

A baby feeding pacifier includes a mounting base in the form of a mouth shield and a pedestal formed on the mouth shield, an annular seat affixed on the pedestal, a support member in the form of an elongated pole also affixed on the pedestal and extending beyond the annular seat, a hollow nipple that has pores between interior and exterior surfaces thereof and inserts into an installed position on the pedestal about the annular seat and the support pole, and a body configured to provide a material adapted for human consumption within and accessible through the pores of the hollow nipple and that seats on the annular seat and fits about the elongated support pole.

20 Claims, 6 Drawing Sheets

(56) References Cited

U.S. PATENT DOCUMENTS

| | | | | |
|---|---|---|---|---|
| 2006/0058845 | A1* | 3/2006 | Fuisz | A61J 7/0046 606/234 |
| 2006/0142800 | A1* | 6/2006 | Charameda | A47G 21/00 606/235 |
| 2007/0021782 | A1* | 1/2007 | Inoue | A61J 17/006 606/234 |
| 2009/0198275 | A1* | 8/2009 | Godown | A61J 17/005 606/236 |
| 2012/0186582 | A1* | 7/2012 | Addington | A61M 11/06 128/200.21 |
| 2014/0257387 | A1* | 9/2014 | Saxton | A61J 17/008 606/236 |

* cited by examiner

BABY FEEDING PACIFIER WITH ENCLOSED EDIBLE PRODUCT

FIELD OF THE INVENTION

The present invention relates to baby pacifiers, and more particularly, is concerned with a baby feeding pacifier with an enclosed edible product.

BACKGROUND OF THE INVENTION

Whether for feeding a mother's milk, a cow's milk or a prepared milk formula, a human or artificial nipple has been the interface with a baby for delivery of the liquid food. It seems natural that a pacifier would be devised that incorporates an artificial nipple for a baby to chew or suck on to reduce periods of stress and crying that frequently occur between feeding times.

A standard prior art pacifier typically has a hollow nipple made of an elastomeric material and a mouth shield supporting the nipple. The nipple is mounted to and extends away from a side of the mouth shield so that the baby can receive the nipple in his or her mouth. The nipple's mounting to the mouth shield prevents the baby from swallowing or choking on the nipple. The standard pacifier also typically has a handle or ring supported and extending from the opposite side of the mouth shield for gripping by a parent or other person attending to the baby's needs in order to insert or withdraw the pacifier nipple into or from the baby's mouth.

Generally speaking, the typical experience with the standard prior art pacifier has been very positive in fulfilling the needs of babies and their parents or attendants. However, the utility of the standard pacifier is fairly short lived; it starts to diminish when the baby begins to get hungry.

Accordingly, there remains a need in the art for an innovation that will overcome the deficiencies of past approaches and the problems that remain unsolved so as to further enhance the utility of a pacifier.

SUMMARY OF THE INVENTION

The present invention is directed to an innovation that overcomes the deficiencies of the past approaches and the problems that remain unsolved by providing a baby feeding pacifier with an enclosed edible product that improves and lengthens the pacifier experience. The baby feeding pacifier provides a hands-free feeding capability while still serving as a pacifier. It may substitute for a portion of a feeding or simply buy time before the next feeding.

In one aspect of the present invention, a baby feeding pacifier includes:

- a mounting base having opposite first and second sides;
- a seat having opposite inner and outer ends and being affixed at the inner end to, and protruding from, the mounting base at the first side thereof;
- a support member extending from the mounting base at the first side thereof through the seat to an outer end portion of the support member being disposed beyond the outer end of the seat;
- a hollow nipple made of a deformable pliable material having pores extending between interior and exterior surfaces of the hollow nipple and having a main portion and a base portion with an open end, the hollow nipple being disposable in an installed position in which the base portion thereof extends about the seat and attaches on the mounting base and the main portion thereof extends from the base portion beyond the outer end of the seat and the outer end portion of the support member so as to form a chamber between the seat and the main portion of the hollow nipple and surrounding the outer end portion of the support member; and
- a body configured to provide a material adapted for human consumption within the chamber and accessible through the pores of the hollow nipple, the body being placed upon the outer end of the seat and fitting about the outer end portion of the support member so as to extend within the hollow nipple beyond the outer end of the seat and the outer end portion of the support member.

In another aspect of the present invention, a baby feeding pacifier includes:

- a mouth shield having a main opening and a pair of opposite sides respectively convex and concave in configuration surrounding the main opening;
- a pedestal formed on the mouth shield so as to extend from the convex side of the mouth shield and form a cavity that is open at the main opening of the mouth shield;
- an annular seat formed on the pedestal so as to extend through the cavity of the pedestal and beyond the main opening and the concave side of the mouth shield;
- a support pole affixed to the pedestal and extending through the annular seat to an outer end portion disposed beyond an outer end of the annular seat and the concave side of the mouth shield;
- a hollow nipple having a tubular body made of a deformable pliable material having pores extending between interior and exterior surfaces of the hollow nipple such that the hollow nipple at one end portion inserts into an installed position on an end wall of the pedestal and extends about the annular seat and the support pole and beyond the outer end portion thereof so as to form a chamber between the annular seat and the tubular body of the hollow nipple and surrounding the outer end portion of the support pole; and
- a body configured to provide a material adapted for human consumption within the chamber and accessible through the pores of the hollow nipple, the body being placed upon the outer end of the annular seat and fitting about the outer end portion of the support pole so as to extend within the hollow nipple beyond the outer end of the annular seat and the outer end portion of the support pole.

In another aspect of the present invention, a baby feeding pacifier includes:

- a mouth shield being arcuate in configuration and having a main opening and a pair of opposite sides respectively convex and concave in configuration surrounding the main opening;
- a pedestal formed on the mouth shield so as to extend from the convex surface of the mouth shield, the pedestal including
  - an annular side wall having inner and outer edges and opposite interior and exterior surfaces extending between the inner and outer edges and being attached at the inner edge to the mouth shield about the main opening thereof and protruding away from the convex side of the mouth shield to the outer edge of the annular side wall being spaced outwardly from the inner edge thereof, and
  - an end wall having opposite interior and exterior surfaces, being flat in configuration and extending across and attached at the interior surface to the outer edge of the annular side wall and spaced from the main opening of the mouth shield such that the pedestal forms a cavity adjacent to the convex side of the mouth shield;

an annular seat having inner and outer ends and opposite interior and exterior sides extending between the inner and outer ends, the annular seat being attached at the inner end thereof on the end wall of the pedestal so as to extend from the interior surface of the end wall through the cavity of the pedestal and through and beyond the main opening and the concave side of the mouth shield, the annular seat being spaced at the exterior side thereof from the interior surface of the annular side wall of the pedestal so as to form an annular slot therebetween that extends to an annular portion of the end wall of the pedestal;

a support pole affixed at one end on the interior surface of the end wall of the pedestal and extending through the annular seat to an opposite end portion disposed beyond the outer end of the annular seat and the concave surface of the mouth shield, the support pole having an exterior surface spaced from and surrounded by the interior surface of the annular seat so as to form an annular void therebetween;

a hollow nipple made of a deformable pliable material having pores extending between interior and exterior surfaces of the hollow nipple such that the hollow nipple at one end portion inserts into an installed position in the annular slot between the pedestal and the annular seat in which the one end portion of the hollow nipple abuts the annular portion of the end wall of the pedestal and an opposite end portion of the hollow nipple extends beyond the concave side of the mouth shield, the outer end of the annular seat and the outer end portion of the support pole so as to form a chamber between the annular seat and the opposite end portion of the hollow nipple and surrounding the opposite end portion of the support pole;

pluralities of male and female elements respectively defined at the one end portion of the hollow nipple and in the annular portion of the end wall of the pedestal that releasably interfit with one another so as to retain the hollow nipple in the installed position in the annular slot within the cavity of the pedestal; and a body configured to provide a material adapted for human consumption within the chamber and accessible through the pores of the hollow nipple, the body being placed upon the outer end of the annular seat and fitting about the outer end portion of the support pole so as to extend within the hollow nipple beyond the outer end of the annular seat and the outer end portion of the support pole.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

Figure 1:
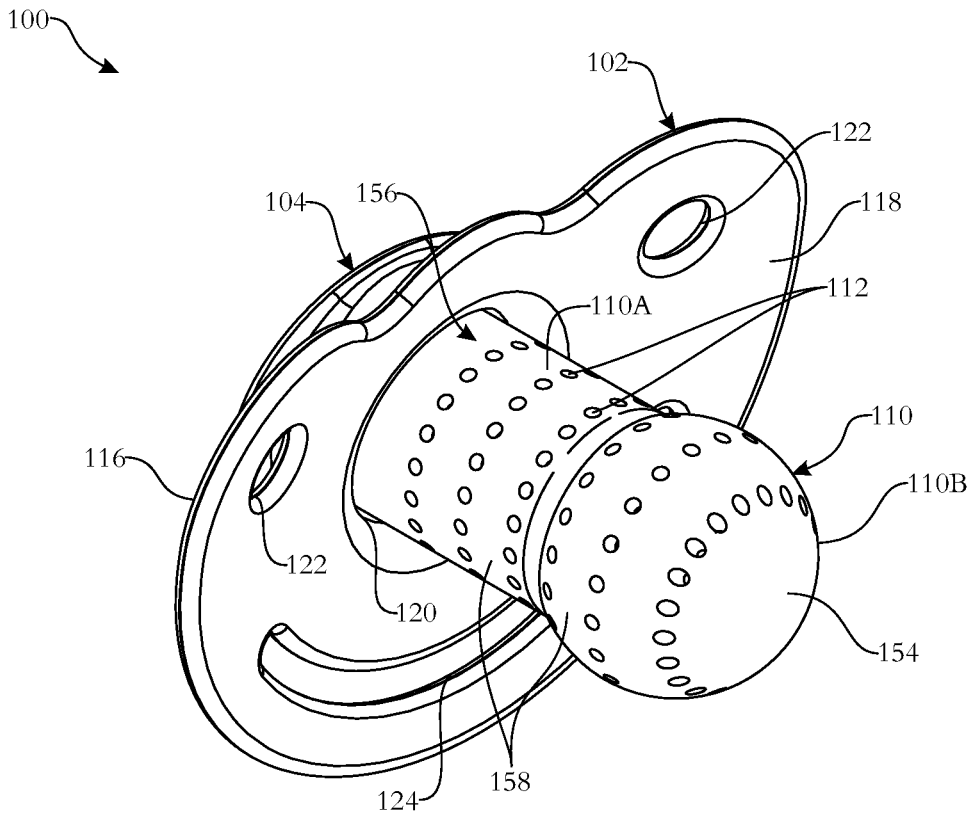
FIG. 1 presents a front isometric assembly view of an exemplary embodiment of a baby feeding pacifier in accordance with aspects of the present invention.
Figure 2:
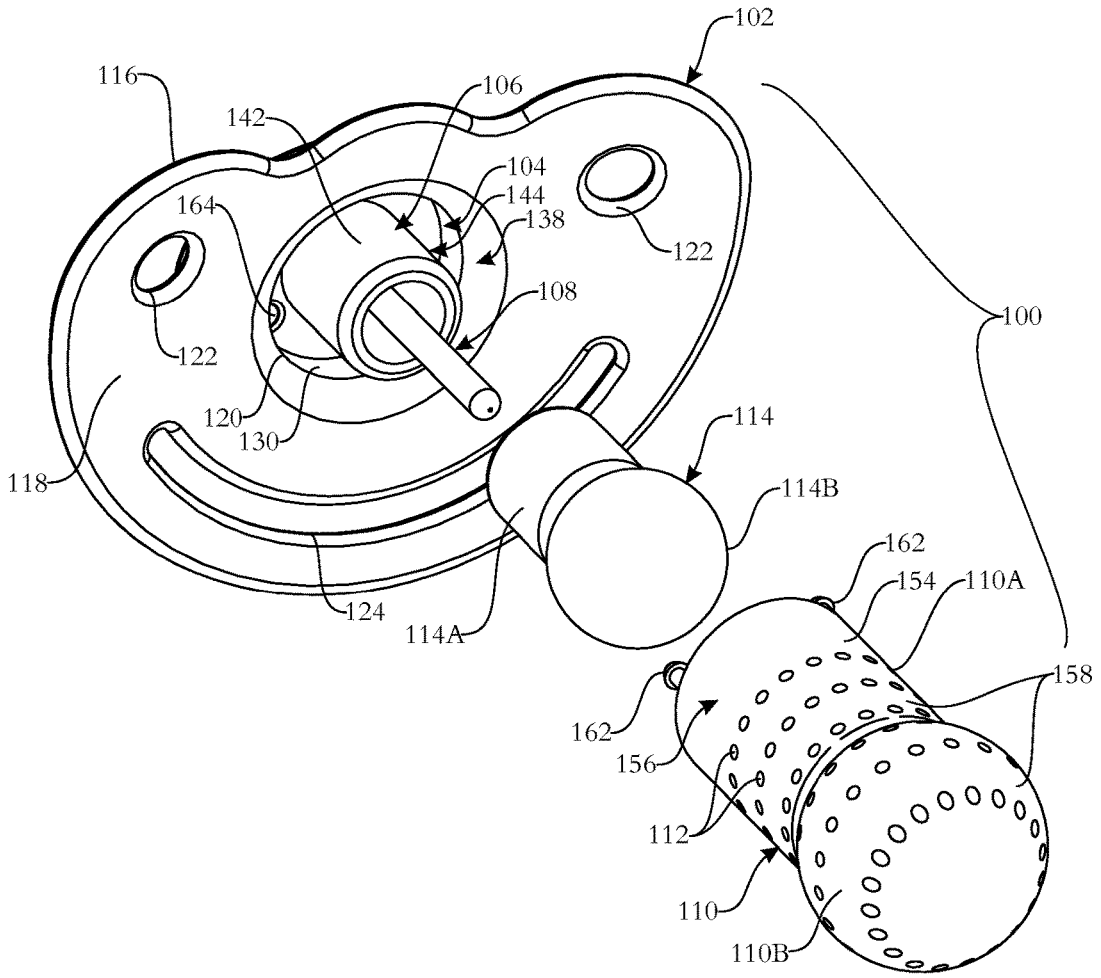
FIG. 2 presents a rear isometric exploded view of the baby feeding pacifier originally introduced in FIG. 1.
Figure 3:
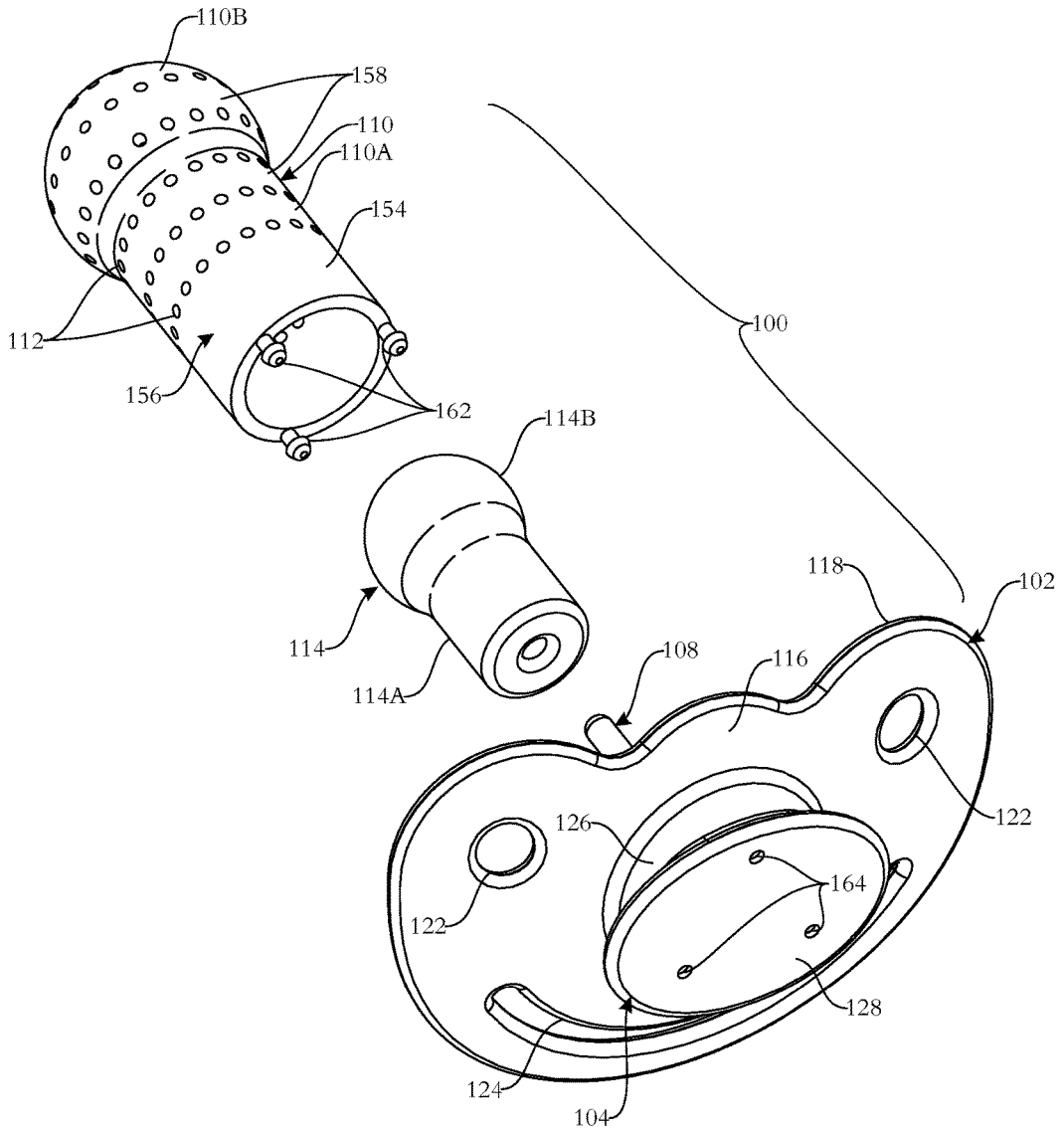
FIG. 3 presents a front isometric exploded view of the baby feeding pacifier originally introduced in FIG. 1.
Figure 4:
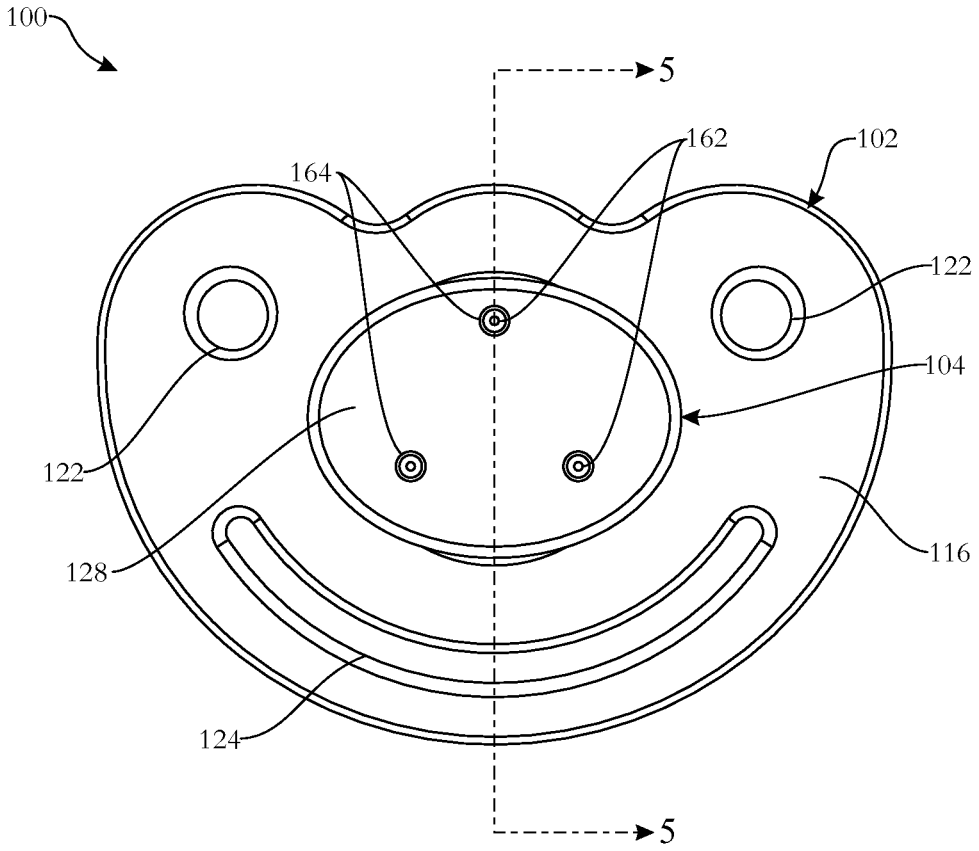
FIG. 4 presents a front elevation view of the baby feeding pacifier originally introduced in FIG. 1.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to FIGS. 1-6, there is illustrated an exemplary embodiment of a baby feeding pacifier, generally designated 100, in accordance with aspects of the present invention. The baby feeding pacifier 100 includes a mounting base in the form of a mouth guard or shield 102 and a pedestal 104 formed on the mouth shield 102, an annular seat 106 affixed on the pedestal 104, a support member in the form of an elongated pole 108 also affixed on the pedestal 104, a hollow nipple 110 that has pores 112 and inserts into an installed position on the pedestal 104 about the annular seat 106 and the elongated support pole 108, and a body 114 configured to provide a material adapted for human consumption within and accessible through the pores 112 of the hollow nipple 110 and that seats on the annular seat 106 and fits about the elongated support pole 108.

More particularly, the mouth shield 102 of the pacifier 100 is generally arcuate in configuration providing opposite sides 116, 118 respectively convex and concave in configuration. The mouth shield 102 also has a main opening 120 as well as a pair of auxiliary openings 122 and an arcuate slot 124 spaced in different directions from the main opening 120. The pedestal 104 of the pacifier 100 is formed on the mouth shield 102 so as to protrude outwardly from the convex side 116 of the mouth shield 102. The pedestal 104 together with the shape of the periphery of the mount shield 102 and the presence of the auxiliary openings 122 and the arcuate slot 124 may be viewed as simulating the face of an animal such as a pig or the like. The auxiliary openings 122 and the arcuate slot 124 also may serve to provide access of air through the openings 122 and slot 124 to areas around the lips L and mouth M of a baby (see FIG. 6) using the pacifier 100 so as to prevent the pacifier from obstructing air flow to these areas.

The pedestal 104 is formed by an annular side wall 126 generally cylindrical in configuration and an end wall 128 generally flat in configuration. The annular side wall 126 has inner and outer edges 126A, 126B and opposite interior and exterior surfaces 130, 132 extending between the inner and outer edges 126A, 126B. The annular side wall 126 is attached at the inner edge 126A to the mouth shield 102 about the main opening 120 thereof. The annular side wall 126 protrudes away from the convex side 116 of the mouth shield 102 to the outer edge 126B of the annular side wall 126, which is spaced outwardly from inner edge 126A thereof. The end wall 128, having opposite interior and exterior surfaces 134, 136, extends across and is attached at its interior surface 134 to the outer edge 126B of the annular side wall 126 of the pedestal 104 such that the end wall 128 is spaced from the main opening 120 and the pedestal 104 forms a cavity 138 adjacent to the convex side 116 of the mouth shield 102. The end wall 128 also has an annular peripheral edge portion 128A that surrounds and extends outwardly from the outer edge 126B of the annular side wall 126 so as to provide a means for easily gripping the pacifier 100 to insert and remove it to and from the baby's mouth M.

The annular seat 106 and the elongated pole 108 serve to hold the body of material 114 in the desired manner in the hollow nipple 110 of the pacifier 100. The annular seat 106 has inner and outer ends 106A, 106B and opposite interior and exterior sides 140, 142 extending between the inner and outer ends thereof. The annular seat 106 is attached at its inner end 106A on the interior surface 134 of the end wall 128 of the pedestal 104 so as to extend therefrom through the cavity 138 of the pedestal 104 and beyond the main opening 120 and the concave side 118 of the mouth shield 102. The annular seat 106 is spaced at its exterior side 142 from the interior surface 130 of the annular side wall 126 of the pedestal 104 so as to form an annular slot 144 therebetween that extends or leads to an annular portion 128B of the end wall 128 of the pedestal 104. The elongated support pole 108 is affixed at one end 108A on a centered location of the interior surface 134 of the end wall 128 of the pedestal 104. The elongated support pole 108 extends through the central void 146 defined by the interior side 140 of the annular seat 106 to an opposite end portion 108B being disposed or protruding beyond the outer end 106B of the annular seat 106 and the concave surface 120 of the mouth shield 102. The elongated support pole 108 has an exterior surface 148 spaced from and surrounded by the interior side 140 of the annular seat 106 so as to form an annular void 150 therebetween.

Figure 5:
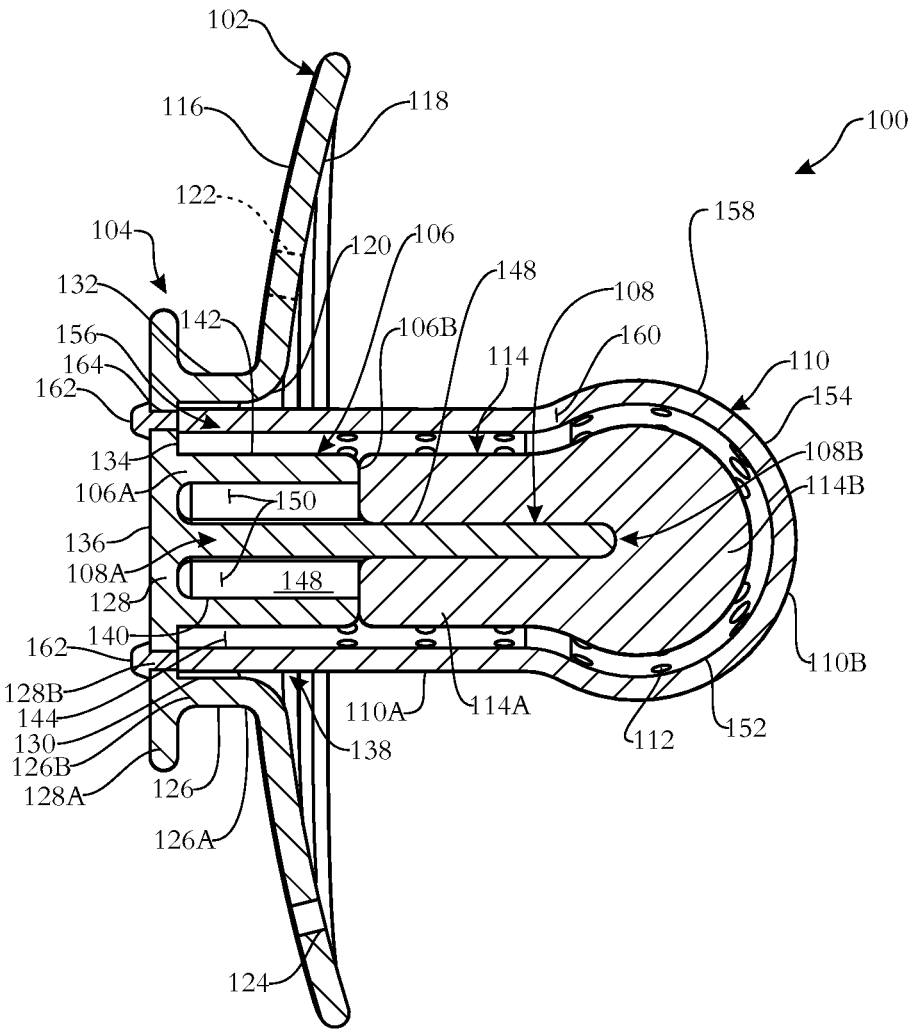
FIG. 5 presents a longitudinally sectioned view of the baby feeding pacifier taken along line 5-5 of FIG. 4.
Figure 6:
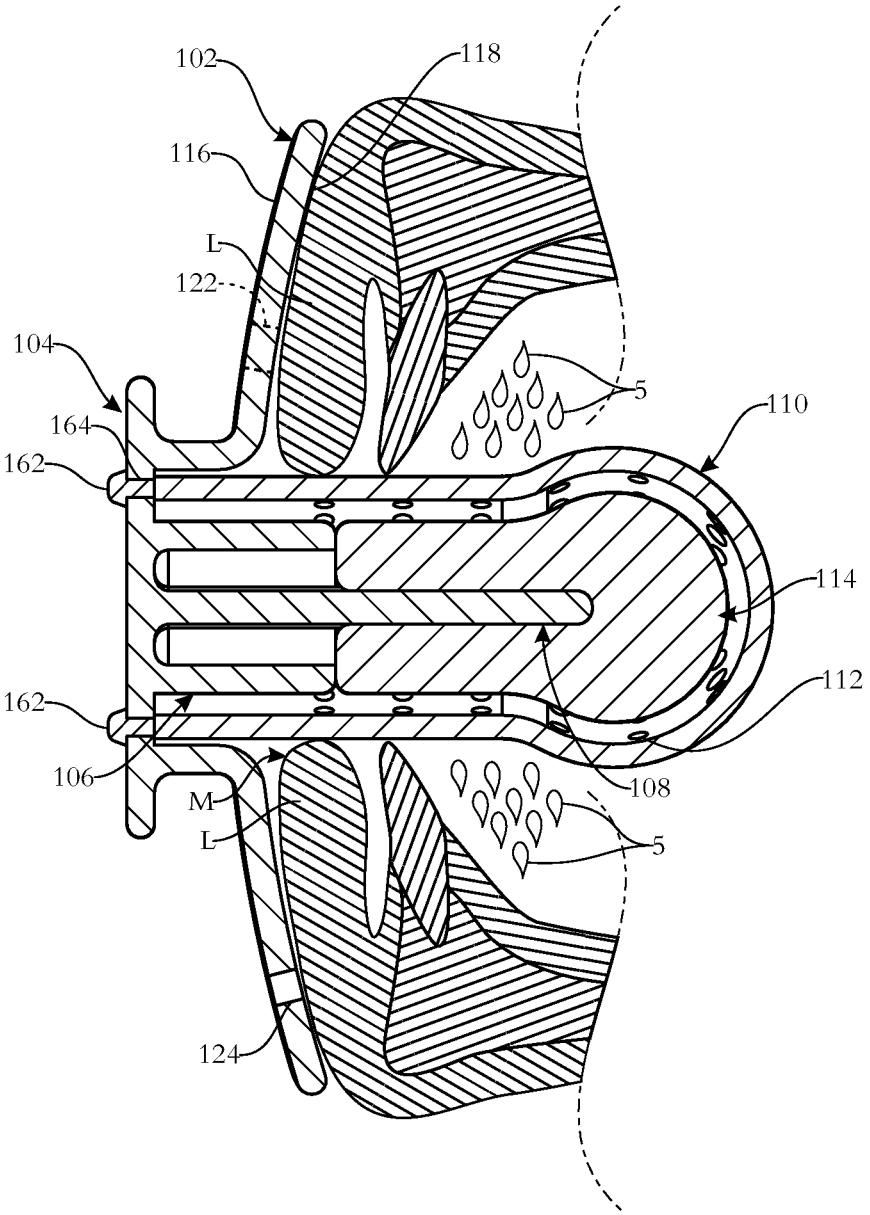
FIG. 6 presents another longitudinally sectioned view of the baby feeding pacifier similar to that of FIG. 5 but on a somewhat enlarged scale and showing the pacifier received in a baby's mouth.

The hollow nipple 110 is made of a deformable pliable material having pores 112 therein that extend between interior and exterior surfaces 152, 154 of the hollow nipple 110. The hollow nipple 110 has a base portion 156 and a main portion 158 with an open end 158A. The hollow nipple 110 is disposable in an installed position, as best seen in FIGS. 5 and 6, wherein it inserts at the one end of the base portion 156 into the installed position in the annular slot 144 between the pedestal 104 and the annular seat 106 in which the base portion 156 abuts the annular portion 128B of the end wall 128 of the pedestal 104 and extends about the annular seat 106 and attaches on the pedestal 104. The main portion 158 of the hollow nipple 110 extends beyond the outer end 106B of the annular seat 106, the concave side 118 of the mouth shield 102 and the outer end portion 108B of the support pole 108 so as to form a chamber 160 between the annular seat 106 and the opposite end of the main portion 158 of the hollow nipple 110 and surrounding the opposite end portion 108B of the elongated support pole 108. Pluralities of male and female elements, embodied as snap-in projections 162 and apertures 164 respectively formed at the one end of the base portion 156 of the hollow nipple 110 and in the annular portion 128B of the end wall 128 of the pedestal 104. The male snap-in projections 162 and female apertures 164 releasably interfit with one another so as to retain the hollow nipple 110 in the installed position in the annular slot 144 within the cavity 138 of the pedestal 104. These elements allow insertion and removal of the hollow nipple 110 to and from the installed position which allows the pacifier 100 to be refilled and reused with a new body of material 114. In the case where the pacifier 100 is intended to be a one-time disposable item, the hollow nipple 110 may be permanently attached to the pedestal 104.

The body 114 is configured to provide a material adapted for human consumption within the chamber 160 and accessible through the pores 112 of the hollow nipple 110. The body 114 has a tubular body section 114A and a spherical head section 114B that are relatively complementary in shape but smaller in size relative to the shape and size of a tubular body 110A and a spherical head 110B (of the base and main portions 156, 158) of the hollow nipple 110. The body of material 114 is intended to be placed upon the outer end 106B of the annular seat 106 and fitted over the outer end portion 108B of the support pole 108 so as to extend within the hollow nipple beyond the outer end 106B of the annular seat 106 and the outer end portion 106B of the support pole 108. The installed hollow nipple 110 covers the body of material 114 so as to prevent breakage of the latter and thereby avoidable of any harm to the baby. The sizes of the pores 112 may vary for gauging a slower or faster entry of a baby's saliva S (see FIG. 6) and the release of the material and access to it through the pores 112 in the nipple 110. The body of material 114 may be provided in a candy-like state and may consist of, by way of example but not limitation, baby formula, milk, flavored milk, supplements, fruit or vegetable juices.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A baby feeding pacifier, comprising:

a mounting base having opposite first and second sides;

a seat having opposite inner and outer ends and being affixed at said inner end to, and protruding from, said mounting base at said first side thereof;

a support member extending from said mounting base at said first side thereof through said seat to an outer end portion of said support member being disposed beyond said outer end of said seat;

a hollow nipple made of a deformable pliable material having pores extending between interior and exterior surfaces of said hollow nipple and having a main portion and a base portion with an open end, said hollow nipple being disposable in an installed position in which said base portion thereof extends about said seat and attaches on said mounting base and said main portion thereof extends from said base portion beyond said outer end of said seat and said outer end portion of said support member so as to form a chamber between said seat and said main portion of said hollow porous nipple and surrounding said outer end portion of said support member; and a body configured to provide a material adapted for human consumption within said chamber and accessible through said pores of said hollow nipple, said body being placed upon said outer end of said seat and fitting about said outer end portion of said support member so as to extend within said hollow nipple beyond said outer end of said seat and said outer end portion of said support member.

2. The pacifier of claim 1 wherein said mounting base comprises:

a mouth shield having a main opening and a pair of opposite sides respectively convex and concave in configuration surrounding said main opening; and a pedestal formed on said mouth shield so as to protrude from said convex side of said mouth shield and form a cavity that is open at said main opening of said mouth shield.

3. The pacifier of claim 2 wherein said seat is annular in configuration and is formed on said pedestal so as to extend through said cavity of said pedestal and beyond said main opening and said concave side of said mouth shield.

4. The pacifier of claim 2 wherein said pedestal comprises:

an annular side wall having opposite inner and outer edges and opposite interior and exterior surfaces extending between said inner and outer edges, said annular side wall defining an opening at said inner edge thereof and being attached at said inner edge to, and protruding away from, said convex side of said mouth shield; and an end wall extending across and attached to said outer edge of said annular side wall and spaced from said main opening of said shield such that said pedestal forms a cavity adjacent to said convex side of said mouth shield.

5. The pacifier of claim 4 wherein said end wall of said pedestal is flat in configuration.

6. The pacifier of claim 4 wherein said seat is annular in configuration and is formed on said end wall of said pedestal so as to extend from an interior side of said end wall through said cavity of said pedestal and beyond said main opening and said concave side of said mouth shield.

7. The pacifier of claim 4 wherein said seat has inner and outer ends and opposite interior and exterior sides extending between inner and outer ends and being attached at said inner end to an interior side of said end wall of said pedestal and spaced at said exterior side from said interior surface of said annular side wall of said pedestal so as to form an annular slot therebetween that extends to an annular portion of said end wall of said pedestal.

8. The pacifier of claim 4 wherein said support member is affixed at one end on an interior side of said end wall of said pedestal and extends through said seat to an opposite end disposed beyond said outer end of said seat and said concave surface of said mouth shield, said support member having an exterior surface spaced from an interior surface of said seat so as to form an annular void therebetween.

9. The pacifier of claim 1 wherein said hollow nipple has a tubular body and a spherical head.

10. The pacifier of claim 1 wherein said body providing said material for human consumption has a tubular body section and spherical head section being complementary in shape but smaller in size relative to the shape and size of said tubular body and said spherical head of said hollow nipple such that a clearance spacing is provided therebetween permitting said hollow nipple to be inserted over said body of material into said installed position in said annular slot within said cavity of said pedestal.

11. The pacifier of claim 2 wherein said mouth shield also has a pair of auxiliary openings and an arcuate slot each spaced in different directions from said main opening.

12. The pacifier of claim 11 wherein said pedestal together with said auxiliary openings, said arcuate slot, and a peripheral shape of said mount shield simulating a face of an animal.

13. The pacifier of claim 12 wherein said face of said simulated animal is a face of a pig.

14. A baby feeding pacifier, comprising:

a mouth shield having a main opening and a pair of opposite sides respectively convex and concave in configuration surrounding said main opening;

a pedestal formed on said shield so as to extend from said convex side of said mouth shield and form a cavity that is open at said main opening of said mouth shield;

an annular seat formed on said pedestal so as to extend through said cavity of said pedestal and beyond said main opening and said concave side of said mouth shield;

a support pole affixed to said pedestal and extending through said annular seat to an outer end portion of said support pole being disposed beyond an outer end of said annular seat and said concave side of said mouth shield;

a hollow nipple having a tubular body made of a deformable pliable material having pores extending between interior and exterior surfaces of said hollow nipple such that the hollow nipple at one end portion inserts into an installed position on an end wall of said pedestal and extends about said annular seat and said support pole and beyond an outer end portion thereof so as to form a chamber between said annular seat and said tubular body of said hollow nipple and surrounding said outer end portion of said support pole; and a body configured to provide a material adapted for human consumption within said chamber and accessible through said pores of said hollow nipple, said body being placed upon said outer end of said annular seat and fitting about said outer end portion of the support pole so as to extend within said hollow nipple beyond said outer end of said annular seat and said outer end portion of said support pole.

15. The pacifier of claim 14 wherein said pedestal comprises:

an annular side wall having opposite inner and outer edges and opposite interior and exterior surfaces extending between said inner and outer edges, said annular side wall defining an opening at said inner edge thereof and being attached at said inner edge to, and protruding away from, said convex side of said mouth shield; and an end wall extending across and attached to said outer edge of said annular side wall and spaced from said main opening of said shield such that said pedestal forms a cavity adjacent to said convex side of said mouth shield.

16. The pacifier of claim 15 wherein said end wall of said pedestal is flat in configuration.

17. The pacifier of claim 15 wherein said mouth shield also has a pair of auxiliary openings and an arcuate slot each spaced in different directions from said main opening.

18. The pacifier of claim 15 wherein said pedestal together with said auxiliary openings, said arcuate slot, and a peripheral shape of said mount shield simulate a face of a pig.

19. A baby feeding pacifier, comprising:

a mouth shield being arcuate in configuration and having a main opening and a pair of opposite sides respectively convex and concave in configuration surrounding said main opening;

a pedestal formed on said mouth shield so as to extend from said convex surface of said mouth shield, said pedestal comprising an annular side wall having inner and outer edges and opposite interior and exterior surfaces extending between said inner and outer edges and being attached at said inner edge to said mouth shield about said main opening thereof and protruding away from said convex surface of said mouth shield to said outer edge of said annular side wall being spaced outwardly from said inner edge thereof, and an end wall having opposite interior and exterior surfaces, being flat in configuration and extending across and attached at said interior surface to said outer edge of said annular side wall and spaced from said main opening of said mouth shield such that said pedestal forms a cavity adjacent to said convex side of said mouth shield;

an annular seat having inner and outer ends and opposite interior and exterior sides extending between said inner and outer ends, said annular seat being attached at said inner end thereof on said end wall of said pedestal so as to extend from said interior surface of said end wall through said cavity of said pedestal and through and beyond said main opening and said concave side of said mouth shield, said annular seat being spaced at said exterior side thereof from said interior surface of said annular side wall of said pedestal so as to form an annular slot therebetween that extends to an annular portion of said end wall of said pedestal;

a support pole affixed at one end at a centered location on said interior surface of said end wall of said pedestal and extending through said annular seat to an opposite end portion disposed beyond said outer end of said annular seat and said concave surface of said shield, said support pole having an exterior surface spaced from and surrounded by said interior surface of said annular seat so as to form an annular void therebetween;

a hollow nipple made of a deformable pliable material having pores extending between interior and exterior surfaces of said hollow nipple such that said hollow nipple at one end portion inserts into an installed position in said annular slot between said pedestal and said annular seat in which said one end portion of said hollow nipple abuts said annular portion of said end wall of said pedestal and an opposite end portion of said hollow nipple extends beyond said concave side of said mouth shield, said outer end of said annular seat and said outer end portion of said support pole so as to form a chamber between said annular seat and said opposite end portion of said hollow nipple and surrounding said opposite end portion of said support pole;

pluralities of male and female elements respectively defined at said one end portion of said hollow nipple and in said annular portion of said end wall of said pedestal that releasably interfit with one another so as to retain said hollow nipple in said installed position in said annular slot within said cavity of said pedestal; and a body configured to provide a material adapted for human consumption within said chamber and accessible through said pores of said hollow nipple, said body being placed upon said outer end of said annular seat and fitting about said outer end portion of the support pole so as to extend within said hollow nipple beyond said outer end of said annular seat and said outer end portion of said support pole.

20. The pacifier of claim 19 wherein:

said hollow nipple has a tubular body and a spherical head; and said body providing said material for human consumption has a tubular body section and spherical head section being complementary in shape but smaller in size relative to the shape and size of said tubular body and said spherical head of said hollow nipple such that a clearance spacing is provided therebetween permitting said hollow nipple to be inserted over said body of material into said installed position in said annular slot within said cavity of said pedestal.

* * * * *